US011278764B1

(12) United States Patent
Falk

(10) Patent No.: US 11,278,764 B1
(45) Date of Patent: Mar. 22, 2022

(54) ELBOW AND WRIST STRETCHING DEVICE

(71) Applicant: Ned Falk, Atlanta, GA (US)

(72) Inventor: Ned Falk, Atlanta, GA (US)

( * ) Notice: Subject to any disclaimer, the term of this patent is extended or adjusted under 35 U.S.C. 154(b) by 0 days.

(21) Appl. No.: 17/134,993

(22) Filed: Dec. 28, 2020

(51) Int. Cl.

| | |
|---|---|
| ***A63B 23/14*** | (2006.01) |
| ***A63B 23/035*** | (2006.01) |
| ***A63B 23/12*** | (2006.01) |
| ***A63B 21/00*** | (2006.01) |
| ***A63B 71/00*** | (2006.01) |
| ***A63B 23/16*** | (2006.01) |
| ***A63B 23/00*** | (2006.01) |

(52) U.S. Cl.
CPC ..... *A63B 23/14* (2013.01); *A63B 21/00047* (2013.01); *A63B 23/03508* (2013.01); *A63B 23/1281* (2013.01); *A63B 23/16* (2013.01); *A63B 71/0054* (2013.01); *A63B 2023/006* (2013.01); *A63B 2225/09* (2013.01)

(58) Field of Classification Search
CPC ..... A63B 21/00; A63B 21/00047; A63B 21/00181; A63B 21/00185; A63B 21/00189; A63B 21/08; A63B 21/16; A63B 21/169; A63B 21/28; A63B 21/285; A63B 21/40; A63B 21/4023; A63B 21/4027; A63B 21/4001; A63B 21/4017; A63B 21/4019; A63B 21/4021; A63B 21/1618; A63B 21/1645; A63B 21/1654; A63B 21/1681; A63B 21/4037; A63B 22/00; A63B 22/0002; A63B 22/0005; A63B 22/0007; A63B 22/0015; A63B 22/0017; A63B 22/0025; A63B 23/00; A63B 23/035; A63B 23/03508; A63B 23/12; A63B 23/1209; A63B 23/12118; A63B 23/1227; A63B 23/1236; A63B 23/1281; A63B 23/129; A63B 23/14; A63B 23/16; A63B 71/0054; A63B 2071/0063; A63B 2071/0072; A63B 2071/0081; A63B 2071/009; A63B 2023/006; A63B 2225/09
USPC ..... 482/46
See application file for complete search history.

(56) References Cited

U.S. PATENT DOCUMENTS 2,693,794 A * 11/1954 Nevillc ..... A61M 5/52 600/499
3,756,222 A * 9/1973 Ketchum ..... A61H 1/0288 601/40
4,585,228 A * 4/1986 Olson ..... A63B 21/065 482/105

(Continued)

*Primary Examiner* — Megan Anderson
*Assistant Examiner* — Thao N Do

(57) ABSTRACT

The present invention comprises a novel stretching device for the stretching the wrist and elbow as part of the treatment for lateral epicondylitis (tennis elbow) and medial epicondylitis (golfer's elbow). Consisting of a vertically (normally wall) mounted device with different embodiments being designed for lateral and medial epicondylitis ailments. For tennis elbow the device includes an angular support projecting from a padded vertical section where the back of the hand is placed. This angular support gradually pushes the back of the fingers guiding the hand into a fist, the optimal stretch for tennis elbow. The golfer's elbow version is designed to accept a palm out fingers up hand. It has a finger and compressible palm support section of different depths, the differences support a gentle stretch of the fingers, when the palm is pushed forward and away from the body.

4 Claims, 4 Drawing Sheets

(56) References Cited

U.S. PATENT DOCUMENTS 4,610,448 A * 9/1986 Hill ..... A63B 23/03533 482/141
4,721,300 A * 1/1988 Guzman ..... A63B 21/0084 482/111
5,022,647 A * 6/1991 Fulcher ..... A63B 21/154 473/229
5,846,168 A * 12/1998 Murray ..... A63B 21/4017 482/105
5,957,813 A * 9/1999 Macdonald ..... A63B 23/16 482/44
6,014,770 A * 1/2000 Spector ..... A63B 71/145 2/161.1
6,085,352 A * 7/2000 Martin ..... A63B 71/14 2/16
6,186,926 B1 * 2/2001 Ellis ..... A63B 21/0615 482/137
6,551,196 B1 * 4/2003 Kossnar ..... A63B 69/3608 473/216
7,121,983 B1 * 10/2006 Trent ..... A63B 21/0004 482/47
9,555,275 B1 * 1/2017 Izzolo, Jr. ..... B32B 5/18
11,077,335 B2 * 8/2021 McRann ..... A63B 23/1218
2002/0198087 A1 * 12/2002 Mitchell ..... A63B 21/4047 482/94
2004/0009853 A1 * 1/2004 Smith ..... A63B 17/04 482/91
2004/0038786 A1 * 2/2004 Kuo ..... A63B 21/4047 482/130
2004/0266593 A1 * 12/2004 Schwendeman ..... A63B 23/12 482/140
2005/0164849 A1 * 7/2005 Saikawa ..... A63B 23/035 482/92
2006/0014615 A1 * 1/2006 Godbold ..... A63B 23/12 482/141
2006/0040809 A1 * 2/2006 Godbold ..... A63B 23/12 482/141
2007/0202995 A1 * 8/2007 Roman ..... A61H 1/0259 482/51
2007/0249473 A1 * 10/2007 Robinson ..... A61K 47/02 482/83
2009/0298656 A1 * 12/2009 Dannenberg ..... A63B 22/14 482/141
2010/0234776 A1 * 9/2010 Borden ..... A63B 23/1263 601/33
2012/0023632 A1 * 2/2012 Provenzano ..... A41D 13/082 2/16
2013/0023391 A1 * 1/2013 Nicholas ..... A63B 23/0355 482/132
2013/0072330 A1 * 3/2013 Cohen ..... A63B 60/40 473/549
2013/0274078 A1 * 10/2013 Andrews ..... A63B 21/4035 482/141
2014/0329647 A1 * 11/2014 Shutts ..... A63B 21/00047 482/111
2015/0013041 A1 * 1/2015 McBride ..... A63B 71/145 2/18
2015/0367170 A1 * 12/2015 Robertson ..... A63B 21/00065 482/139
2016/0263424 A1 * 9/2016 LaCaze ..... A63B 21/4035
2017/0296864 A1 * 10/2017 Richter ..... A63B 23/0211
2019/0329111 A1 * 10/2019 Moran ..... A63B 71/0622
2020/0406122 A1 * 12/2020 Engler ..... A63B 71/08
2021/0106901 A1 * 4/2021 Vaillancourt ..... A63B 71/143

* cited by examiner

ELBOW AND WRIST STRETCHING DEVICE

FIELD OF THE INVENTION

The present invention relates to wrist, elbow and forearm stretching devices and apparatuses to encourage proper stretching form and thus benefit the most from stretching to improve the rehabilitation of injuries to muscles and tendons in the forementioned body parts.

BACKGROUND

Elbow tendinitis sometimes referred to as Tennis elbow or Golfer's Elbow. Each ailment effects different tendons. Tennis elbow, is medically referred to as Lateral Epicondylitis and effects the Outside tendon of the elbow. Golfer's elbow (medial epicondylitis) is a pain associated with the tendon on the inside of your elbow. Both ailments are normally caused by excessive use. Despite the obvious references to sport, the injuries aren't limited to golfers or tennis players, you could experience Elbow Tendinitis because of a work or hobby overuse scenario. Part of the accepted physical therapy to improve these ailments include specific stretches of the wrist and forearm thus effecting the tendons in the Elbow. Additional treatments include massage of the affected area.

Although these ailments are normally treated with physical therapy that involves stretching the wrist and forearm and thus the connected tendons of the elbow. The need to stretch the wrist and forearm can be part of treatment for other injury or surgical recovery plans. One example, would be as part of a recovery plan for wrist surgery. In addition, the use of the stretching can also be a way to avoid injury in the first place.

The physical therapy technique of stretching of the wrist and forearm is currently done using different poses depending on the injury and the affected area. These poses often require the use of the unaffected hand to pull and force the stretch of the area on the affected arm/wrist. For example, if your right elbow or wrist was injured, you would stretch with the assistance of the left hand pulling back the right wrist with either the palm up or down. In addition to using the opposite hand to initiate the stretch, a vertical surface/wall can be used for resistance and to cause the wrist to stretch. One Pose for Tennis elbow as well as for other wrist related surgeries and conditions also involves the making of a first to increase the pull/stretch of the tendons.

In addition to the stretching aspect of the physical therapy, massage of the affected area is often performed to aid recovery. The option to do this massage while stretching is now only possible with the assistance of another person, or using the wall technique. This is because the first technique requires the use of your other hand or the hand of the therapist.

The use of the wall technique to stretch is sub-optimal for two reasons. The first reason is that the use of the hard wall surface is uncomfortable. The second, is that it does not promote the optimal stretch. In the case of the stretch for tennis elbow, (arm extended and palm facing toward the body) the wall technique also does not encourage the proper first closure to achieve maximum stretch. In the case of golfer's elbow, the wall technique does not allow the fingers to be pulled back towards the body while the palm is facing upward.

BRIEF SUMMARY OF THE INVENTION

The present invention comprises a novel device that consists of foam or otherwise soft material in combination with more firm foam or hard plastic/metal other materials attached to a wall in the proper configuration to assist the user in correctly stretching the wrist and forearm. In different embodiments of the invention, the devise is designed with different features. For example, with tennis elbow in mind (palm facing toward the body), the device has a configuration which gently positions the hand into a fist. In the palm facing away from the body and fingers up stretch (used for golfers elbow), the device's configurations allows the fingers to be pushed toward the body in a gradual way simulating the action of the traditional stretch that previously requires the use of your opposite hand. In all embodiments of the invention, the device is mounted to a vertical surface. This frees up your opposite hand to perform a massage on the effected elbow. It is also envisioned that the various embodiments of the invention have adjustable elements. In the case of the version for golfer's elbow an adjustable feature would change the degree that the fingers are pushed back ward toward the body. In the case of the tennis elbow versions the degree of angle causing the fingers to form a first might be adjustable.

Any technique to mount the device to the wallor vertical surface is possible. In a situation like a physical therapist office a more permanent mounting with for example screws or strong tape makes sense. Due however, to the temporary nature of the injury for one person, a releasable tape system or suction cup mount is preferred. These would encourage the mounting and use of the device in the shower, or to mount it on the refrigerator as a built-in gentle reminder to stretch. The use of the device in the shower gives the additional benefit of warm water flowing on the injury at the same time as a massage and stretch optimizing the benefit of the basic stretch to speed recovery.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several figures.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of design elements are disclosed. Each of these has individual benefit and each can also be used in conjunction with one or more, or in some cases all, of the other disclosed elements. Accordingly, for the sake of clarity, this description will refrain from repeating every possible combination of the individual steps in an unnecessary fashion. Nevertheless, the specification and claims should be read with the understanding that such combinations are entirely Within the scope of the invention and the claims.

New devices to assist in proper stretching of tendons in treatment of lateral epicondylitis also known as tennis elbow and medial epicondylitis also known as golfers elbow are described below. In addition, these new devices may aid in the treatment of wrist related injuries as well as a method to avoid injury to the wrist and elbow.

The present disclosure is to be considered as an exemplification of the invention, and is not intended to limit the invention to the specific embodiments illustrated by the figures or description below.

The present invention will now be described by referencing the appended figures representing preferred embodiments.

Figure 1:
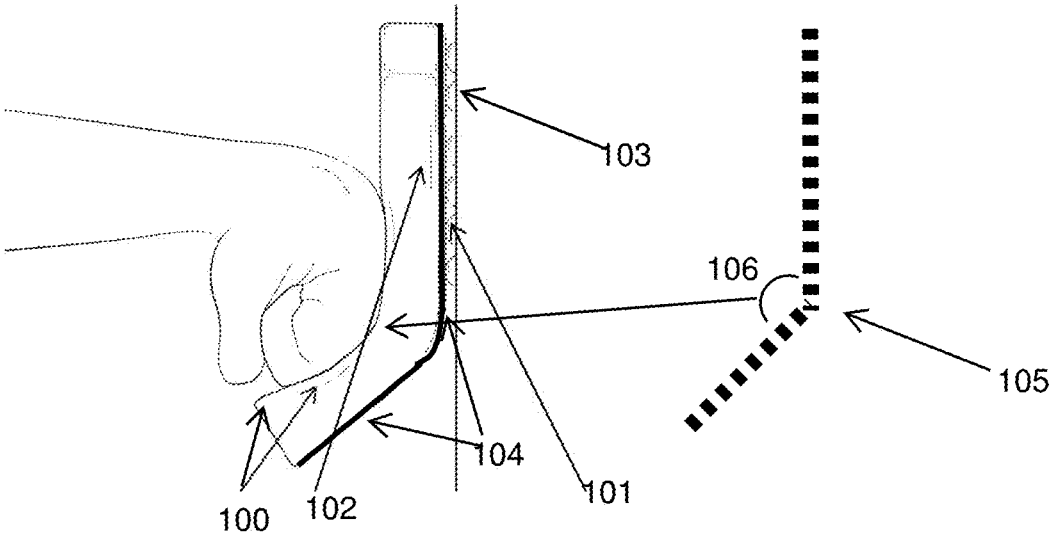
FIG. 1 depicts one embodiment of the invention designed for stretching when you have tennis elbow. It is shown with a hand in the position it would be in during use, with the palm of the hand down and facing toward the body when the arm is extended

Referring to FIG. 1. This embodiment of the invention designed for stretching to relieve the symptoms of tennis elbow. With the arm extended and the palm facing toward the body the back of the hand is shown in the proper position when using the device. Rigid member 104 supports a foam pad in bottom angled section 100 and the vertical section 102. The angle of the pad near section 100 is designed to gently push the fingers closed into a fist. This is the optimal position to stretch the elbow. Also depicted is a suction cup grouping 101 as one way to mount the device, on a vertical surface such as a wall 103. Shown in addition is the idea of the adjustability of the device where 105 shows the current embodiment's approximate angle but with easy rotation of the lower section thru angle 106.

Figure 2:
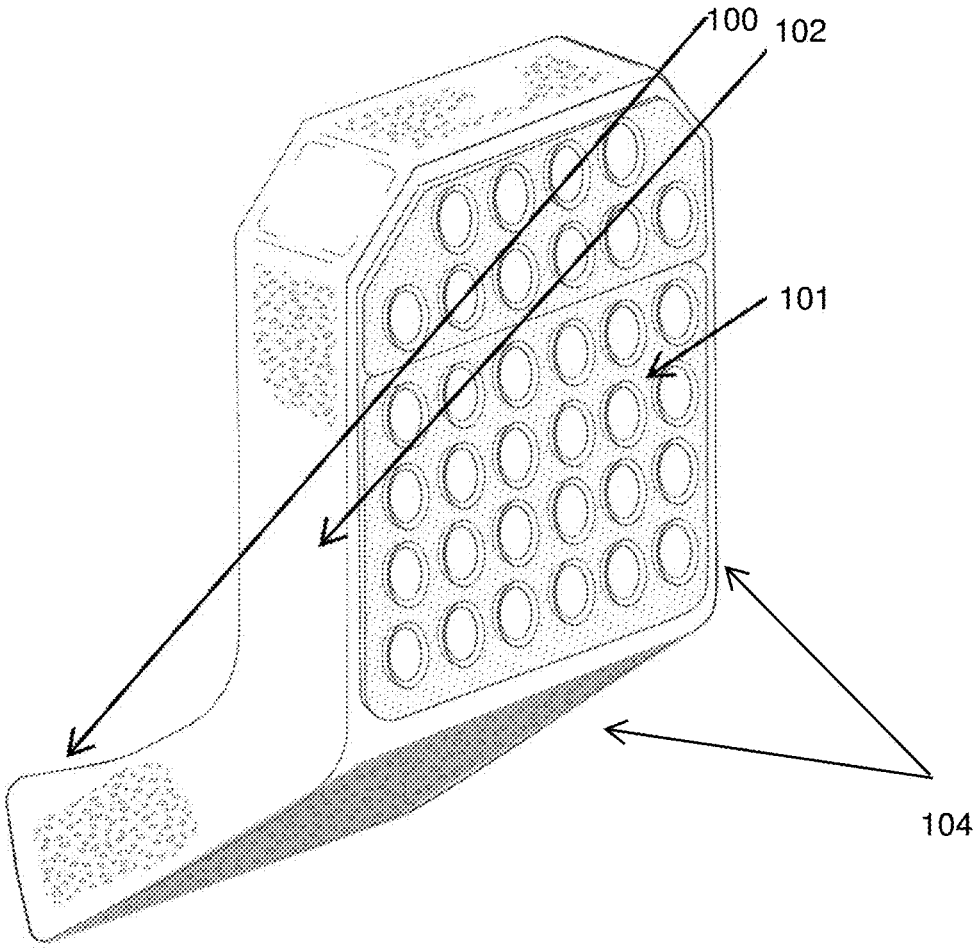
FIG. 2 illustrates a different perspective of the embodiment shown in FIG. 1. This time without the device in use.

Referring to FIG. 2. Another view of the same embodiment shown in FIG. 1. Although this view clearly depicts the use of suction cups to attach the device to the wall, however other attachment methods to the wall or vertical surface would include but not be limited to screws, nails glue, hook and loop or releasable tape.

Figure 3:
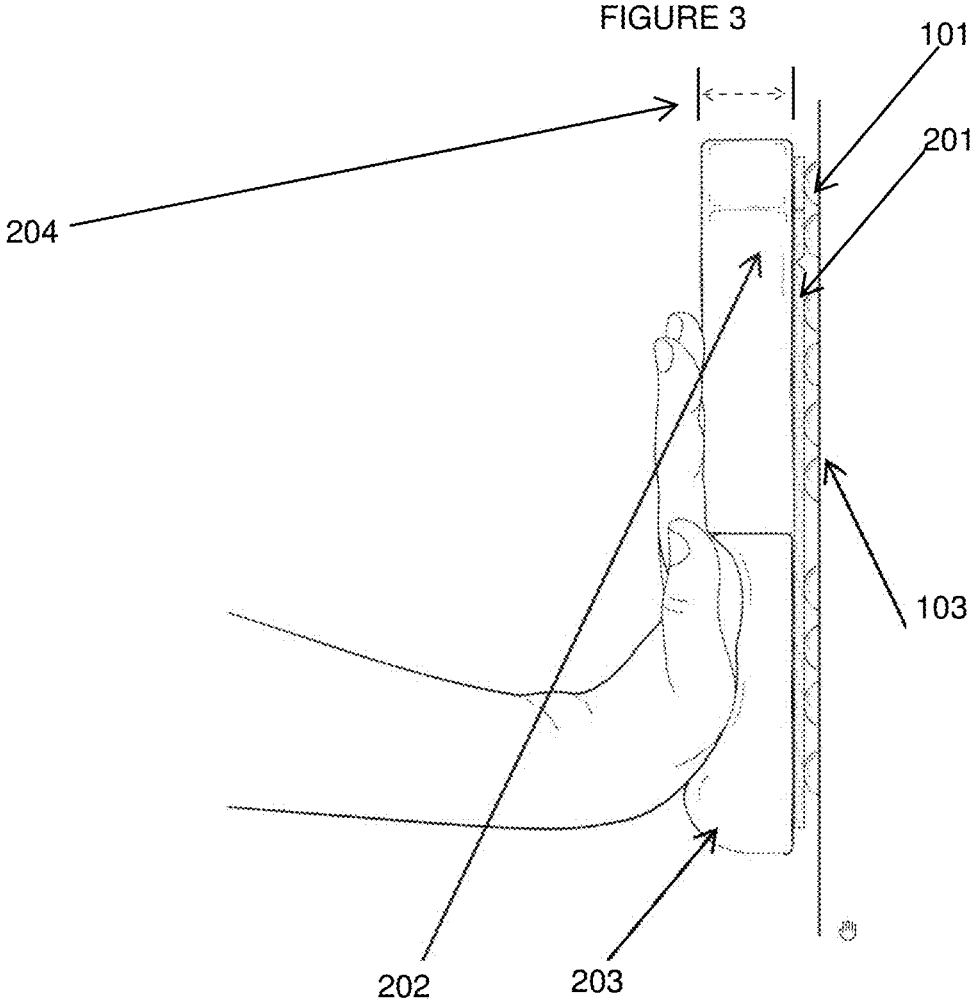
FIG. 3 shows the embodiment of the invention used in the treatment of golfers elbow. It depicts the invention being used with the palm faceup away from the body.

Referring to FIG. 3, this embodiment is the one designed for golfer's elbow. When in use with the arm extended fingers pointed up and the palm out, the palm is pressed against soft foam 203, while the fingers are supported by a firmer area 202. The difference in the compressed thickness of 203 vs the compressed thickness of area 202 will gradually allow the palm to be positioned farther away from the body while the fingers are getting resistance as they are not moving as far from the body. Adjusting the thickness 204 of the finger support pad 202 and firmness of area 202 would promote more or less stretch. This is because the fingers would effectively be pushed back in relation to the palm. To complete the description of this figure, 201 depicts a rigid support for the foam pads, 101 depicts an attachment method using suction cups to the wall 103.

Figure 4:
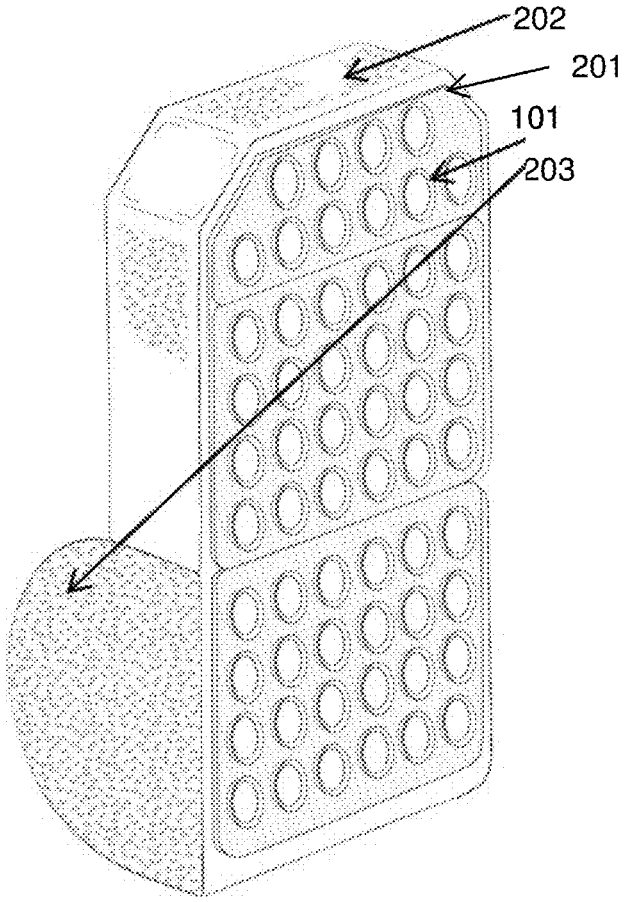
FIG. 4 depicts an different profile of the embodiment pictured in FIG. 3.

Referring to FIG. 4, this shows the same embodiment as FIG. 3. It shows a larger view of the back of the device where it is mounted to a vertical surface/wall. As previously mentioned, different attachment methods are envisioned.

I claim:

1. A stretching device for the wrist and elbow configured to be mounted vertically on a wall comprising a vertical section configured to receive a back of a hand, the vertical section comprising an angular bottom section projecting from the vertical section away from the wall configured to push on back of fingers of the hand to support and gently force the fingers of the hand in to a closed first position, when the back of the hand is pressed against the vertically positioned section.

2. The stretching device for the wrist and elbow according to claim 1 further comprising a soft foam area positioned on the angular bottom portion of the stretching device for cushioning and pushing on the back of the fingers to gently force the hand into a fist.

3. The stretching device for the wrist and elbow according to claim 2 further comprising an adjustable angle that during set up is configured to be adjusted to force the fingers into a tighter or looser fist, the adjustable angle configured to be locked in place during use between the bottom part of the device which supports the back of the fingers and the vertical portion of the device where the back of the hand is positioned.

4. The stretching device for the wrist and elbow according to claim 1 further comprising a soft foam area on the vertical section for cushioning the back of the hand when the back of the hand is pressed against the soft foam area.

* * * * *